United States Patent [19]

Masovich et al.

[11] Patent Number: 4,844,548

[45] Date of Patent: Jul. 4, 1989

[54] HAULAGE UNIT OF A COAL-GETTING MACHINE

[75] Inventors: Felix Z. Masovich; Jury I. Osokin; Alexandr A. Pukis, all of Moscow; Nikolai I. Stepanov, Poselok Perlovka; Vyacheslav I. Shishlov, Moscow, all of U.S.S.R.

[73] Assignee: Gosudarstvenny Proektno-Konstruktorsky I Experimentalny Institut Ugolnogo Mashinostroenia "Giprouglemash", Moscow, U.S.S.R.

[21] Appl. No.: 191,142

[22] PCT Filed: Aug. 3, 1987

[86] PCT No.: PCT/SU87/00086

§ 371 Date: Mar. 30, 1988

§ 102(e) Date: Mar. 30, 1988

[87] PCT Pub. No.: WO88/01011

PCT Pub. Date: Feb. 11, 1988

[30] Foreign Application Priority Data

Aug. 4, 1986 [SU] U.S.S.R. ..... 4100850

[51] Int. Cl.[4] ..... E21C 29/02

[52] U.S. Cl. ..... 299/43; 105/29.1

[58] Field of Search ..... 299/34, 42, 43; 198/735; 105/29.1

[56] References Cited

U.S. PATENT DOCUMENTS 4,025,120 5/1977 Balinov et al. ..... 299/43
4,055,367 10/1977 Jarvis ..... 299/43 X
4,088,370 5/1978 Jarvis et al. ..... 299/43
4,357,052 11/1982 Pilarski et al. ..... 299/42

FOREIGN PATENT DOCUMENTS 831962 5/1981 U.S.S.R. ..... 299/43
1265322 10/1986 U.S.S.R. .
1521687 8/1978 United Kingdom .

OTHER PUBLICATIONS

*Polish Technical Review* "Chainless Shearer—Loader Haulage System", vol. 136, No. 2, (1981), p. 22.

*Primary Examiner*—Jerome W. Massie
*Assistant Examiner*—David J. Bagnell
*Attorney, Agent, or Firm*—Fleit, Jacobson, Cohn, Price, Holman & Stern

[57] ABSTRACT

A haulage unit of a coal-getting machine comprises a drive (1) an output shaft of which is associated with a conveyor (2) through the medium of a kinematic linkage. The kinematic linkage incorporates a sprocket (3) installed on the output shaft and meshing elements (4) coming in mesh with teeth of the sprocket (3). The meshing elements (4) are installed for rotation about the axis thereof and for a limited longitudinal displacement in a guide (5). The guide (5) is essentially presented by links articulated to one another. Each link is installed on a carrying element (7) secured on the conveyor (2) and is formed by two arcuate elements (8,9) facing each other by concave portions thereof, and connected in a diametrical plane by at least two fastening members (10) so that a clearance (11) is formed between the arcuate elements. Each fastening member (10) mounts the meshing element (4) in the form of a rolling body. The haulage unit comprises at least two grips (14, 15) installed at a definite distance from each other, secured on the driven (1) and cooperating with each link of the guide (5). One grip (14) is disposed in a zone where a sprocket tooth cooperates with the meshing element (4).

4 Claims, 4 Drawing Sheets

HAULAGE UNIT OF A COAL-GETTING MACHINE

TECHNICAL FIELD

The present invention relates to mining machines and more particularly to haulage units of coal-getting machines.

PRIOR ART

Known to the prior art is a coal-getting machine haulage unit (SU, A, 576,815), comprising a drive, an output shaft of which is kinematically associated with a conveyor, and at least two grips installed at a definite distance from each other and secured on the drive housing.

The kinematic linkage incorporates a sprocket installed on the output shaft of the drive and meshing elements coming in mesh with the sprocket teeth. The meshing elements made in the form of pins are installed for rotation about an axis thereof and for a limited longitudinal displacement in a guide. The guide is made tubular in shape and is essentially presented by links articulated with one another. Each link is installed on a carrying element secured on the conveyor. Each grip cooperates with each link of the guide. One grip is disposed in the zone where a sprocket tooth cooperates with the meshing element.

End faces of the pins are provided with projections made in the form of hemispheres and disposed outside the guide.

In comparison with widely known haulage units of coal-getting machines in which the meshing elements are fixedly installed in the guide, the known haulage unit of the coal-getting machine has a comparatively high hauling efficiency and features reliable and durable operation. However a small diameter of the pins limits the hauling capacity and friction of the grips on the guides cuts down the hauling efficiency.

DISCLOSURE OF THE INVENTION

It is an object of the present invention to provide a haulage unit of a coal-getting machine featuring such kinematic linkage elements and their interconnection that would ensure high hauling capacities and efficiency of the machine and reduce large overall dimensions of the unit.

These and other objects of the invention are accomplished by that in a haulage unit of a coal-getting machine, comprising a drive having an output shaft of which is associated with a conveyor through the medium of a kinematic linkage incorporating a sprocket installed on the output shaft, meashing elements coming in mesh with teeth of the sprocket and installed for rotation about their axis and for a limited longitudinal displacement in a guide which is essentially presented by articulated links, each of which is installed on a carrying element secured on the conveyor, and at least two grips installed at a definite distance from each other, secured on the drive and cooperating with each link of the guide, one grip being disposed in the zone where a sprocket tooth cooperates with the meshing element, according to the invention, each link of the guide is made up of two arcuate elements facing each other by concave portions thereof and connected in a diametrical plane by means of at least two fastening members so that a clearance is formed between the arcuate elements, and each fastening member mounts a meshing element made in the form of a rolling body.

To provide a constant distance between the axis of the guide and the axis of rotation of the sprocket, it is desirable that rests should be made on the internal surface of the guide and disposed on both sides of the guide axis.

Such a design embodiment improves an accuracy in the meshing, reduces the losses in the meshing elements and minimizes the friction between the grip and the guide.

The surface of the body of rolling cooperating with a sprocket tooth may advantageously be made spherical in shape.

This will make it possible to maintain a constant meshing when a need arises for changing the angle of inclination of the drive output shaft.

It is preferred to dispose a bushing with a shoulder on the end face thereof between the fastening member and a respective rolling body so that the rolling body should embrace the bushing and rest on the shoulder.

Such a design embodiment allows the rolling body to align itself in a position ensuring the constant meshing with a sprocket tooth.

The proposed haulage unit of the coal-getting machine accomplished according to the invention makes it possible to increase the output of the coal-getting machine and provides a comparatively high reliability and durability of the construction. In addition, the proposed haulage unit has comparatively small overall dimensions which makes it possible to widen the field of its application, especially for mining thin seams.

BRIEF DESCRIPTION OF THE DRAWINGS

To enable the invention to be understood more clearly the embodiment thereof in the form of a haulage unit of a coal-getting machine will hereafter be more fully described with reference to the accompanying drawings, wherein.

DETAILED DESCRIPTION OF THE PREFERRED EMBODIMENT

Figure 1:
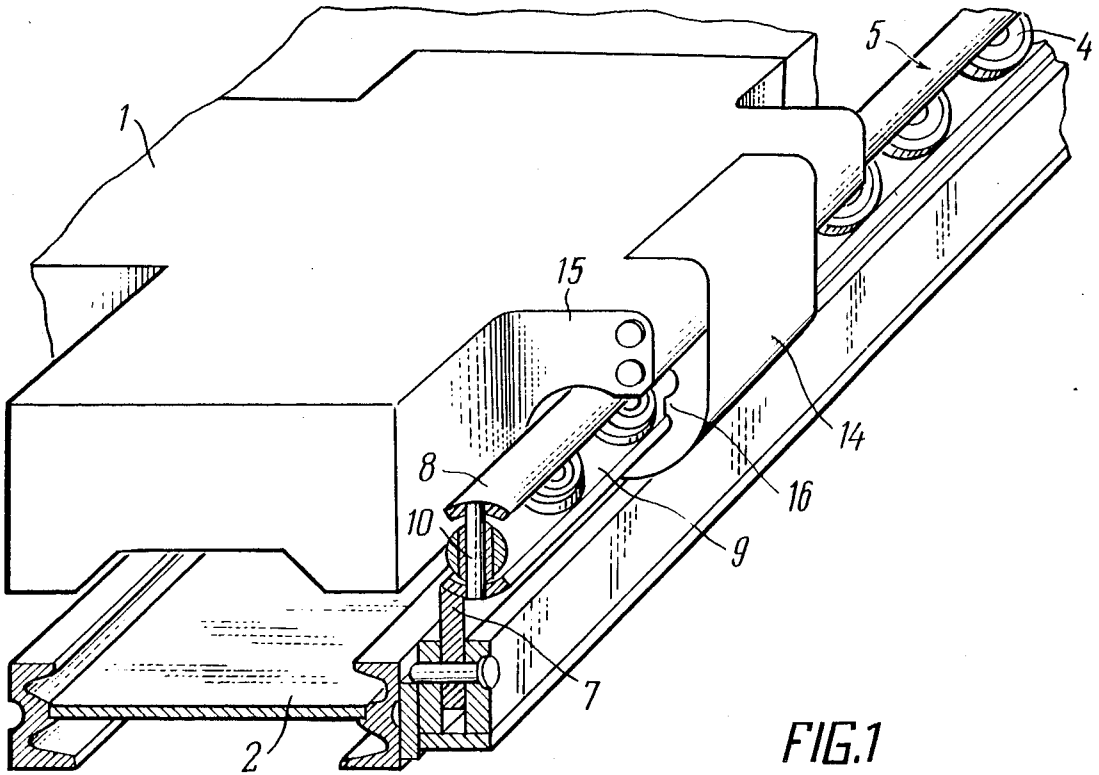
FIG. 1 illustrates a general view of the haulage unit of a coal-getting machine.
Figure 2:
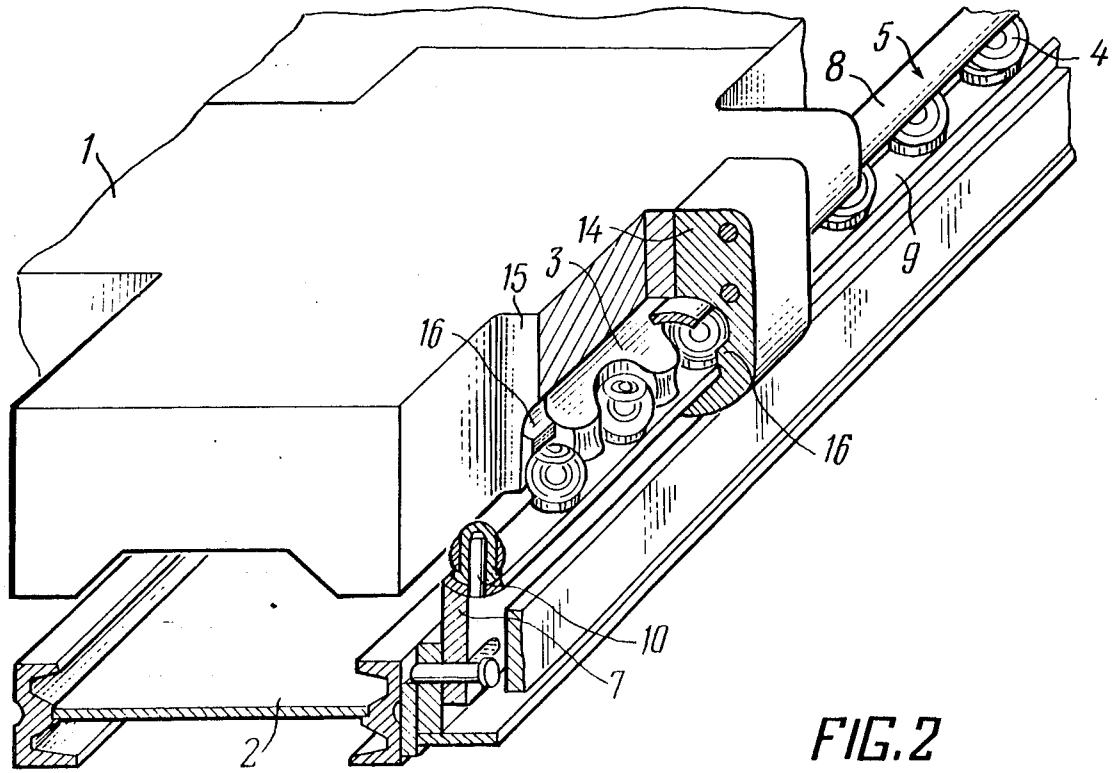
FIG. 2 is a view like FIG. 1, partially in cut-away.
Figure 3:
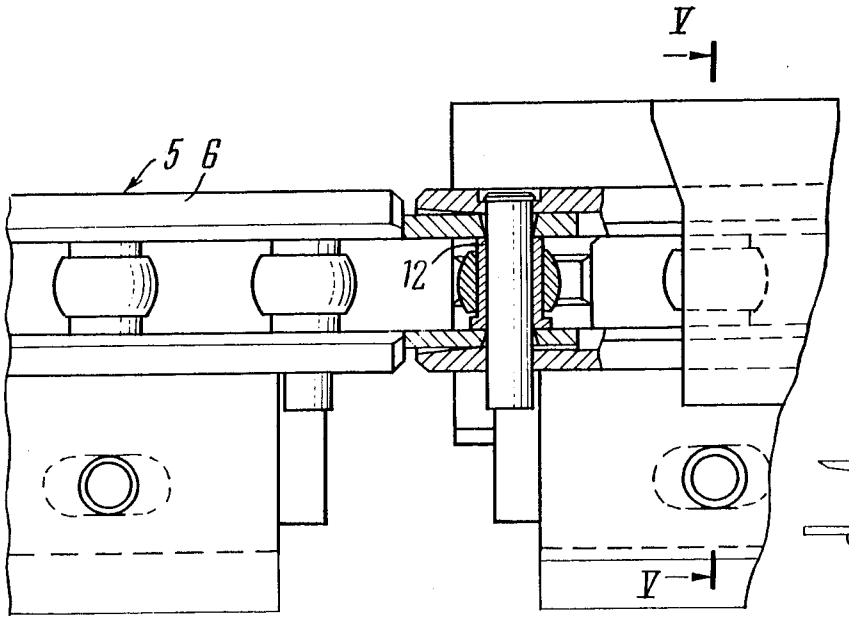
FIG. 3 illustrates connection of guide links.

The haulage unit of a coal-gettting machine comprises a drive 1 (FIG. 1) having an output shaft (not shown) of which is associated with a conveyor 2 through the medium of a kinematic linkage incorporating a sprocket 3 (FIG. 2) installed on the output shaft (not shown) and meshing elements 4 coming in mesh with involute-spherical teeth of the sprocket 3. The meshing elements 4 are installed for rotation about the axis thereof and for a limited longitudinal displacement in a guide 5 (FIG. 3). The guide 5 is essentially presented by links 6 articulated with one another.

Each link 6 is installed on a carrying element 7 (FIG. 1) secured on the conveyor 2.

Figure 4:
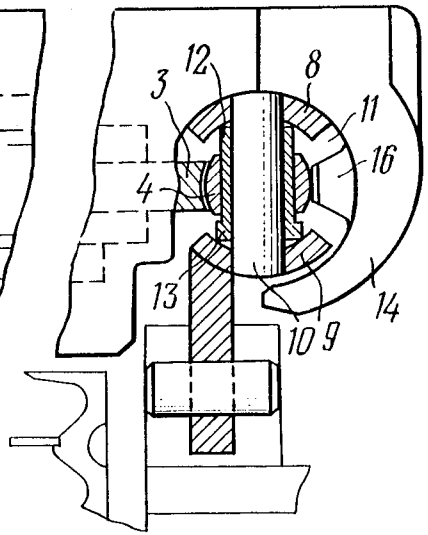
FIG. 4 is a section taken along the line IV—IV of FIG. 3.

Each link 6 (FIG. 3) of the guide 5 is formed by two arcuate elements 8 and 9 (FIG. 4) facing each other by concave portions thereof. The arcuate elements 8 and 9 are connected in a diametrical plane by means of at least two fastening members 10 so that a clearance 11 is formed between the arcuate elements 8 and 9.

Each fastening member 10 mounts a meshing element 4 made in the form of a rolling body. In a specific embodiment of the invention the surface of the rolling body 4 cooperating with a tooth of the sprocket 3 may advantageously be made spherical in shape.

A bushing 12 with a shoulder 13 provided on the end face thereof may suitably be disposed between the fastening member 10 and the rolling body 4 so that the rolling body 4 will embrace the bushing 2 and will rest on the shoulder 13. The bushings 12 limit the axial displacement of the rolling body 4. The axial displacement of the rolling body 4 may also be limited by means of inserts, rubber shims, springs (not shown).

Th haulage unit of a coal-getting machine comprises at least two grips 14 and 15 installed at a definite distance from each other and secured on the housing of the drive 1.

Figure 5:
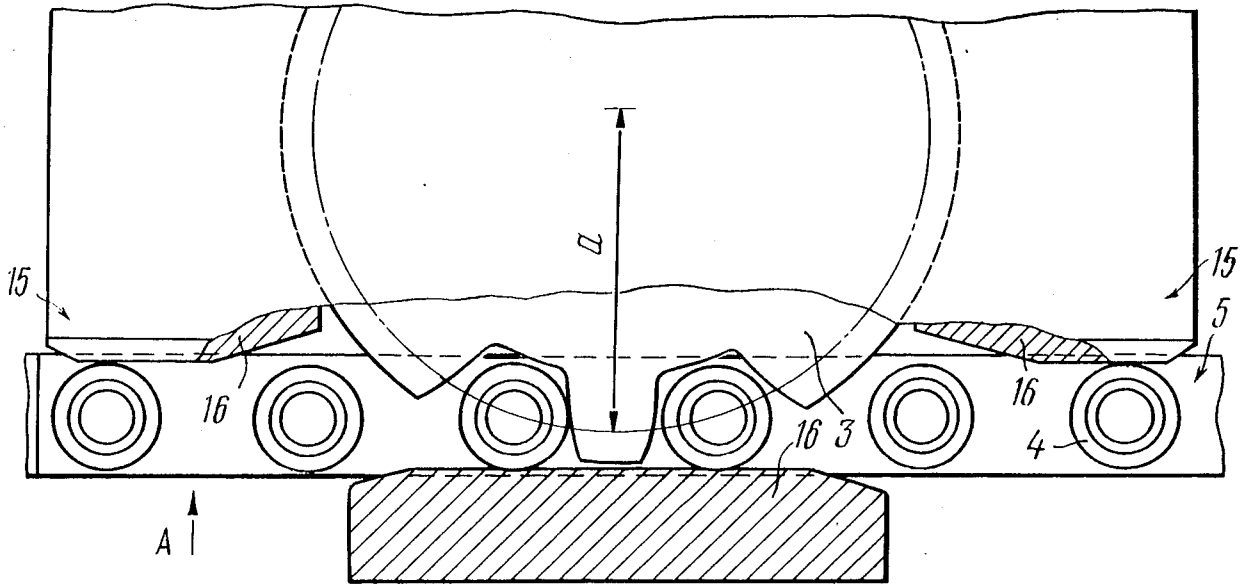
FIG. 5 illustrates cooperation of sprocket teeth with meshing elements.

To maintain a constant distance "a" between the axis of rotation of the sprocket 3 (FIG. 5) and the axis of the guide 5 ensuring a constant cooperation of the body 4 of rolling with a tooth of the sprocket 3, the haulage unit of the coal-getting machine is provided with a means in the form of rests 16 made on the internal surface of the grips 14 and 15.

The proposed haulage unit of a coal-getting machine operates in the following way.

When the haulage unit of the coal-getting machine is switched on, the sprocket 3 whose teeth are in mesh with the rolling bodies 4 and the surface of which is made spherical in the zone of cooperation with the teeth of the sprocket 3 starts to rotate and the coal-getting machine is put in motion.

At the same time the grips 14 and 15 while moving along the rolling guide 5 cooperate by their rests 16 with the bodies 4 and maintain the distance "a" between the axis of rotation of the sprocket 3 and the axis of teh guide 5 constant, thereby ensuring the design parameters of the meshing. The rests 16 while rolling along the rolling bodies 4 substantially reduce the resistance to motion of the coal-getting machine on the guide 5, as the sliding friction is replaced by the rolling friction. All the advantages described hereinabove improve the efficiency of the coal-getting machine haulage unit.

Due to increase in the diameter of the bodies 4 of rolling the surface thereof cooperating with the teeth of the sprocket 3 has been substantially enlarged which made it possible to considerably increase the hauling capacity of the coal-getting machine haulage unit.

Due to the spherical surface of the body 4 of rolling cooperating with a tooth of the sprocket 3 having a conjugate involute-spherical profile, there is ensured a constant meshing in case of changing the angle of inclination of the output shaft of the drive 1.

At the same time the bushing 12 with the shoulder 13 provided at the end face thereof sets the body 4 of rolling in a position which allows the latter to align itself properly when the coal-getting machine is moving along the guide 5.

INDUSTRIAL APPLICABILITY

The present invention may be most advantageously used in conveyor-mounted machines engaged in getting mineral resources, coal in particular, in stoping faces of mines by the method of underground mining.

What we claim is:

1. A haulage unit of a coal-getting machine, comprising:

a drive having an output shaft associated with a conveyor through the agency of a kinematic linkage, a sprocket incorporated in said kinematic linkage and installed on the output shaft, meshing elements, a guide in which said meshing elements come in mesh with teeth of the sprocket and are installed for rotation about their axes and for a limited longitudinal displacement, articulated links essentially presenting said guide, each of which is installed on a carrying element secured on the conveyor, and at least two grips installed at a distance from each other, secured on the drive and cooperating with each articulated link of the guide, one of said grips being disposed in a zone where a tooth of the sprocket cooperates with one of the meshing elements, each articulated link being made up of two arcuate elements having concave portions thereof facing each other and being connected in a diametrical plane by at least two fastening members so that a clearance is formed between the arcuate elements, each fastening member mounting at least one of said meshing elements, each of said meshing elements made in the form of a rolling body.

2. A haulage unit as claimed in claim 1, characterized in that for ensuring a constant distance between an axis of the guide and an axis of rotation of the sprocket, an internal surface of the one of said grips is provided with rests disposed on both sides of the guide.

3. A haulage unit as claimed in claim 1, characterized in that a surface of the rolling body cooperating with a tooth of the sprocket is made spherical in shape.

4. A haulage unit as claimed in claim 1, characterized in that a bushing with a shoulder on an end face thereof is disposed between each fastening member and the respective rolling body so that the rolling body embraces the bushing and rests on the shoulder.

* * * * *